United States Patent [19]

Schreier

[11] 3,971,284

[45] July 27, 1976

[54] PLURAL MODE ENVELOPE GENERATOR FOR VOLTAGE CONTROLLED AMPLIFIER

[75] Inventor: Wilford R. Schreier, Bensenville, Ill.

[73] Assignee: Hammond Corporation, Chicago, Ill.

[22] Filed: Mar. 3, 1975

[21] Appl. No.: 554,437

Related U.S. Application Data

[63] Continuation-in-part of Ser. No. 447,905, March 4, 1974, Pat. No. 3,898,905.

[52] U.S. Cl. ..... 84/1.26; 84/1.13; 84/1.24

[51] Int. Cl.[2] ..... G10H 1/02; G10H 5/02

[58] Field of Search ..... 84/1.01, 1.13, 1.24, 84/1.26

[56] References Cited

UNITED STATES PATENTS

| | | | |
|---|---|---|---|
| 2,972,273 | 2/1961 | Hanert | 84/1.26 |
| 3,558,796 | 1/1971 | Harris | 84/1.26 |
| 3,570,357 | 3/1971 | Adachi | 84/1.26 |
| 3,571,481 | 3/1971 | Adachi | 84/1.13 |
| 3,821,458 | 6/1974 | Schreier | 84/1.13 |
| 3,828,110 | 8/1974 | Colin | 84/1.01 |
| 3,886,834 | 6/1975 | Okamoto | 84/1.24 X |
| 3,886,836 | 6/1975 | Hiyoshi | 84/1.26 |
| 3,897,709 | 8/1975 | Hiyoshi et al. | 84/1.24 X |

*Primary Examiner*—L. T. Hix
*Assistant Examiner*—Stanley J. Witkowski
*Attorney, Agent, or Firm*—Lowell C. Bergstedt

[57] ABSTRACT

A plural mode envelope generator in which a basic time constant circuit is coupled by selector switches to a plurality of envelope generating means which function under the control of one or both of a keydown detector and a legato pulse generator. Fast attack-short substain and slow attack-long sustain envelope circuits involve standard techniques. A dual mode percussion circuit provides post key release sustain in one mode when the keydown detector is decoupled from the circuit and post key release tone snubbing when the keydown detector is coupled to the circuit. A sostenuto circuit with flip-flop latch includes a reset gate to hold the flip-flop in reset until sostenuto keying is desired whereupon a unidirectional circuit couples the initial keydown signal to the latch to place the flip-flop in a set state but prevents the disappearance of that signal from resetting the latch.

6 Claims, 2 Drawing Figures

PLURAL MODE ENVELOPE GENERATOR FOR VOLTAGE CONTROLLED AMPLIFIER

This application is a continuation-in-part of my earlier, co-pending application Ser. No. 447,905, filed Mar. 4, 1974 entitled "A monophonic Electronic Musical Instrument", now U.S. Pat. No. 3,898,905.

This invention relates to electronic musical instruments and more particular to a plural mode envelope generator for a voltage controlled amplifier.

The particularly advantageous aspect of this invention is the use of a single basic time constant circuit as a common element of selectable envelope generator circuits. This invention also advantageously employs a dual mode percussion circuit in which a keydown signal is either coupled or decoupled to produce post key release snubbing or sustain, respectively. Sostenuto, fast attack-short sustain, and slow attack-long sustain circuits are in parallel with the dual mode percussion circuit and operate from the keydown detector.

Figure 1:
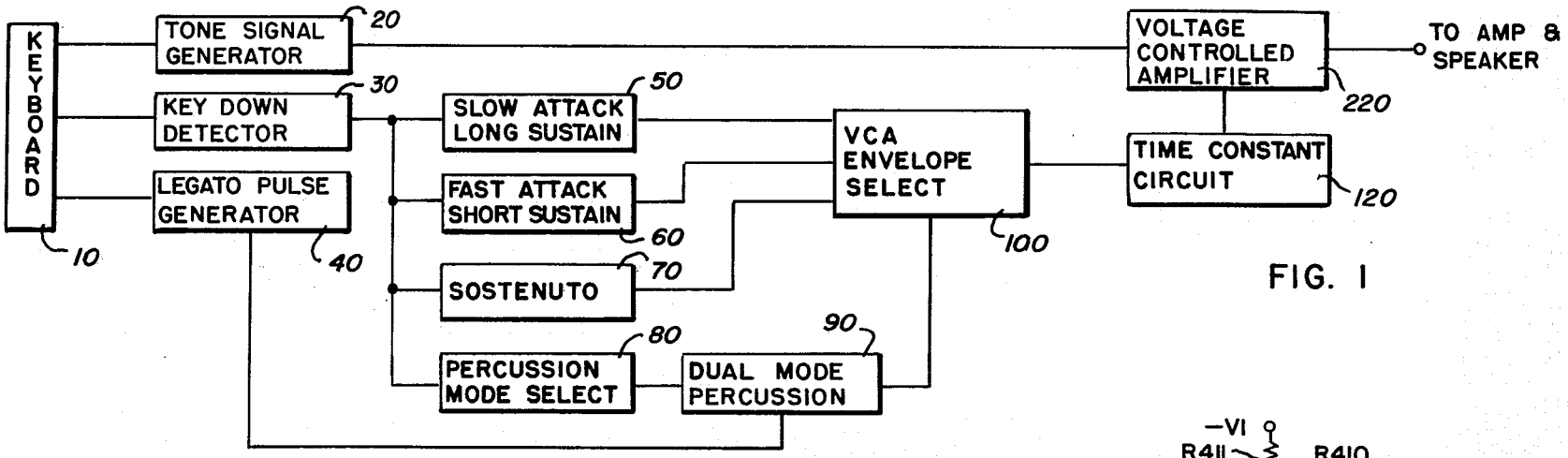
FIG. 1 is a block diagram of a preferred embodiment of this invention.

Referring to FIG. 1, a keyboard 10 controls the operation of the one signal generator 20, keydown detector 30, and legato pulse generator 40. Tone signal generator 20 is preferably of the latching type and produces electric tone signals corresponding to actuated keys on keyboard 10. Tone signal generator 20 is either monophonic or polyphonic, and in the latter case plural tone signals are coupled to a single voltage controlled amplifier 220 for unitary keying. The invention is most useful, however, in a monophonic synthesizer in which only one tone at a time is generated. Keydown detector 30 detects when any one or more keys on keyboard 10 are actuated and produces a keydown signal in response thereto. Legato pulse generator 40 detects when any new effective key is actuated (e.g. a higher key in a monophonic high select keyboard-tone generator system) and produces a short pulse.

A keydown signal from keydown detector operates three envelope signal generating circuits: a slow attack-long sustain circuit 50, a fast attack-short sustain circuit 60, and a sostenuto circuit 70. It also is fed to a mode select circuit 80 which controls the operating mode of a dual mode percussion type of envelope signal generating circuit 90. A legato pulse from legato pulse generator 40 operates dual mode percussion circuit 90. All of the envelope generating circuits are selectively coupled to a basic time constant circuit 120 through envelope select circuit 100. The output of time constant circuit 120 controls the operation of voltage controlled amplifier 220. Specific versions of keyboard 10, tone signal generator 20, keydown detector 30, legato pulse generator 40, and voltage controlled amplifier 220 are disclosed in the above-referenced allowed Schreier application and are not required here.

Figure 2:
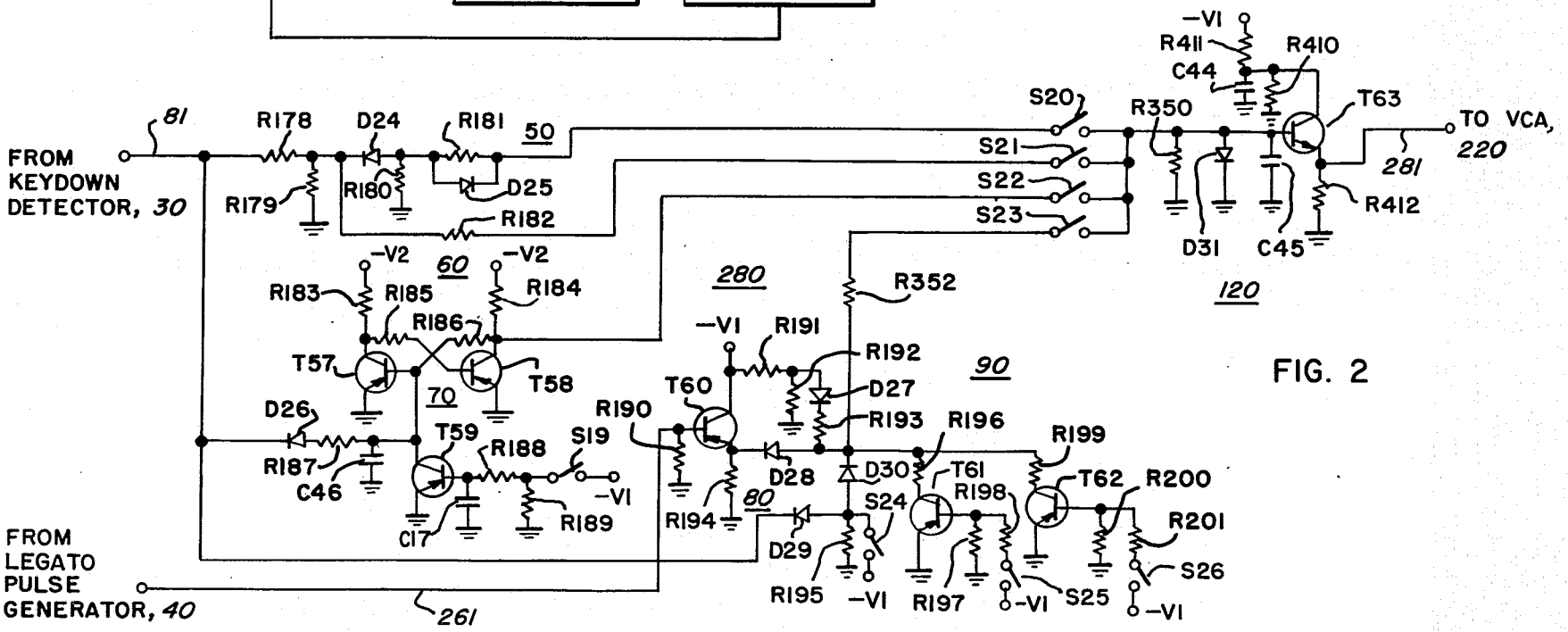
FIG. 2 is a schematic circuit diagram of a preferred embodiment of this invention.

The above-referenced Schreier application also contains a table of typical component values and types for the circuitry shown in FIG. 2. That table is specifically incorporated herein by reference to illustrate a set of components values and types that will produce a satisfactory result.

Referring to FIG. 2, lead 81 has thereon a keydown signal developed by keydown detector 30 in FIG. 1. Thus, lead 81 has a negative D.C. keying signal thereon as long as any keyswitch in any octave is actuated. With swtich S20 closed a slow attack circuit comprising resistors R180 and R181 and diodes D24 and D25 are coupled to time constant capacitor C45. Transistor T63 and related circuit components comprise an emitter follower driver stage with the voltage on time constant capacitor C45 reproduced on the emitter of transistor T63. The value of resistor R181 is chosen such that, upon occurrence of a negative keydown signal, timing capacitor C45 is slowly charged to a maximum negative voltage (the voltage on the junction of resistors R178 and R179), producing a slowly rising D.C. control voltage on control lead 281 and thus a slow attack (slow rise in amplitude) of the tone signal output from amplifier 220. (Resistor R178 are in small value and this little effect on time constants.) When the keydown signal disappears, the voltage on lead 81 goes to ground and timing capacitor C45 discharges through resistors R350 and R180 in parallel. Diode D25 routes discharge current around resistor R181 to remove it from the discharge path and diode D24 blocks discharge current from resistor R179. The discharge time constant, and thus the tone decay rate, is controlled mainly by resistor R180 since it is lower in value than resistor R350. With switch S20 closed, the tone signal comes on slow when a key is depressed and decays slowly when a key is released. However, the slow attack of tone is only provided during detached note playing since the keydown signal will remain if a second note is playing before releasing the first.

Switch S21 controls operation of a fast attack fast decay circuit comprising resistors R182 and R179. Resistor R182 has a value such that, upon occurrence of a negative keydown signal, timing capacitor C45 is very rapidly charged to maximum negative voltage, producing a rapidly rising D.C. control voltage on control lead 281, and thus attack of the tone signal output from amplifier 220. When the keydown signal disappears, timing capacitor C45 discharges primarily through resistors R182 and R179 which are of low value and thus produce fast decay of the tone signal.

Switches S22 and S19 control the operation and coupling of a sostenuto circuit to timing capacitor C45. The sostenuto circuit comprises transistors T57 to T59 and related circuit components. Transistors T57 and T58 are interconnected in a typical bistable flip-flop configuration. Transistor T59 has its base electrode connected through normally closed switch S19, and thus it is normally on to hold the flip-flop circuit in reset by grounding the base of transistor T57 which turns transistor T57 off and transistor T58 on. With transistor T58 on, its collector is at ground potential, and thus capacitor C45 and lead 281 are at ground and amplifier 220 is off when the sostenuto control switches S19 and S22 are acutated (S19 opens, S22 closes). When S19 opens, transistor T59 goes off, and the ground clamp is removed from the base of flip-flop transistor T57. But the flip-flop is in reset, so capacitor C45 and control lead 281 are at ground and amplifier 220 is off. The first negative keydown signal after sostenuto control switches are acutated is coupled to the base of transistor T57 which turns transistor T57 on and transistor T58 off, placing the flip-flop in a set state. The voltage on the collector of transistor T58 rises to a predetermined fraction of −V2 and capacitor C45 rapidly charges to that potential. Thus, amplifier 220 turns on with fast attack. Upon release of a keyswitch, the keydown signal goes to ground but diode D26 prevents the ground from reaching the base of transistor T57 so the flip-flop remains in a set state and amplifier 220 stays on at fixed gain for each tone signal fed into it. The note and octave word latches have memorized the last played tone and thus it will sound until a new note is played. Each successive note played will sound in sostenuto fashion regardless of whether the keyswitch is kept actuated. When the sostenuto control switches are released (S19 closed, S22 opened), transistor T59 is rapidly turned on by the negative-going signal on its base due to resistor R188 and capacitor C47. Thus the base of transistor T57 rapidly goes to ground, and the flip-flop circuit is flopped back to the reset state. The last played tone dies away slowly as capacitor C45 discharges through R350 unless a make before break set of switch contacts is used so that the ground on the collector of transistor T58 rapidly discharges capacitor C45 before switch S22 opens.

Switch S23 controls the coupling of percussion sustain circuits to capacitor C45. Transistors T60, T61, and T62 together with related circuit components comprise a multimode percussion sustain circuit which functions under the control of input keydown and legato pulse signals on leads 81 and 261 respectively. The legato pulse circuit has not yet been described; but for purposes of the present description, it is sufficient to state that the legato pulse is a short negative-going pulse on lead 261 which occurs each time a new effective high note has been played. Thus, this legato pulse occurs each time a new tone signal is presented to amplifier 220.

The negative-going legato pulse is coupled to the base of transistor T60 to turn transistor T60 on for an instant only to send a fast charging pulse to capacitor C45 as its emitter goes to −V1 and this negative voltage is coupled through diode D28 and resistor R352 to capacitor C45. Resistor R352 has a low value which provides for fast attack but prevents transients which would produce undesirable effects. When transistor T60 turns off, capacitor C45 begins to discharge rapidly through resistors R352, R191, and R192 until the voltage across capacitor C45 equals the potential at the junction of resistors R191 and R192 (preferably about −5 volts). At this time diode D27 becomes back biased and no longer conducts current through this fast discharge path. This initial fast discharge occurs in every operating mode of the percussion sustain circuit and provides for definite distinct strike tones when notes are repetitively keyed in rapid fashion.

The first mode of operation of the percussion sustain circuit occurs when switch S24 is closed to back bias diodes D29 and D30 with −V1 volts. This prevents the disappearance of the keydown signal from terminating the sustain tail on the gated percussion tone. Otherwise when the signal on lead 81 goes to ground after key release, diodes D29 and D30 would immediately discharge capacitor C45 and thus cut off the tone signal. Consequently, with switch S24 closed, the sustained percussion tone continues to die away slowly even after release of the keyswitch. With switch S24 open, the sustained percussion tone terminates abruptly upon key release. This is the second mode of operation.

The percussion sustain time constant, after the initial stage of fast discharge of capacitor C45, is controlled by switches S25 and S26. With switches S25 and S26 open, the second stage of discharge of capacitor C45 occurs only through resistor R350 and is very slow.

With switch S26 closed (S25 open), transistor T62 turns on to place resistor R199 in the discharge path; but resistor R199 has a high value so the second stage of discharge is still quite slow. With switch S25 closed, transistor T61 turns on to place resistor R196 in the discharge path. Since resistor R196 has a relatively low value, the second stage of discharge is very rapid and, in fact, is more rapid than the first stage of decay. It should be apparent that additional circuits could be added to provide other discrete second stage decay times. And, if desired, either or both of the first and second stages of decay could be controlled by potentiometers available to the player. Thus, by operation of switch S24 the percussion sustain circuit is switched from a post key release terminate mode to a post key release continue mode of percussion sustain and by operation of switches S25 and S26 the time constant of the second stage of tone decay is variable between slow and fast decay. Of course, switch S23 controls whether the amplifier envelope generator is in the percussion sustain mode or not.

It should be understood that the above descriptions of preferred embodiments of this invention are given by way of example only and numerous modifications could be made therein without departing from the scope of the claims set forth below.

I claim:

1. In combination in an electronic musical instrument:

a plurality of selectively actuable control elements for controlling the sounding of musical notes;

a keydown detector for detecting when any one of said control elements is actuated to produce a keydown signal;

a legato pulse generator for producing a legato pulse signal each time an additional one of said control elements is effectively actuated;

a tone signal generator coupled to said control elements for producing electrical tone signals in response to actuation thereof;

a voltage controlled amplifier for gating said electrical tone signals to an output circuit; and voltage envelope control circuitry for said voltage controlled amplifier comprising:

a basic time constant circuit comprising an input lead, an output lead coupled to said voltage controlled amplifier, and a resistor and capacitor coupled in parallel between said input and output leads and ground;

a plurality of envelope signal generating means coupled individually to one or both of said keydown detector and said legato pulse generator, each adapted to be operatively coupled to said input lead of said basic time constant circuit to produce a different envelope signal on said output lead thereof; and selector circuit means for selectively coupling individual ones of said envelope signal generating means to said input lead.

2. The combination as claimed in claim 1, wherein one of said envelope signal generating means is a dual mode percussion circuit comprising:

charging circuit means for transmitting said legato pulse signal as a rapid charging signal to said capacitor in said basic time constant circuit;

discharge circuit means for discharging said capacitor at a selected rate after said legato pulse signal has expired; and percussion mode select circuit means coupled between said keydown detector and said capacitor and having a first selectable operating state in which said keydown detector is effectively connected to said capacitor to discharge said capacitor rapidly upon release of all control elements and a second selectable operating state in which said keydown detector is effectively disconnected from said capacitors to enable said discharge circuit means to continue discharging said capacitor at said selected rate even after release of all control elements.

3. The combination as claimed in claim 2, wherein said discharge circuit means comprises a plurality of resistive discharge paths selectively coupled in parallel to said capacitor to discharge said capacitor at different rates.

4. The combination as claimed in claim 3, wherein said discharge circuit means further comprises an additional parallel discharge path including a resistor of relatively small value and diode coupled in series between said capacitor and a voltage intermediate the charged voltage of said capacitor and ground reference potential to discharge said capacitor rapidly to said intermediate voltage upon expiration of said legato pulse whereupon said diode becomes back biased to eliminate said additional discharge path.

5. The combination as claimed in claim 2, wherein said percussion mode select circuit means comprises a pair of oppositely poled diodes coupled in series between said keydown detector and said capacitor and a switch selected bias circuit coupled to the junction of said diodes for selectively back biasing both diodes to disconnect said keydown detector from said capacitor; and wherein said discharge circuit means comprises a plurality of switch operable transistor gates for switching resistors of different values into and out of parallel discharge paths for said capacitor.

6. The combination as claimed in claim 1, wherein said tone signal generating means is of the latching type such that the last played tone signal continues after release of its related control element; and one of said envelope generating means is a sostenuto circuit comprising:

a bistable flip-flop circuit having an output coupled to said capacitor;

a reset gate operable to keep said flip-flop circuit in reset until sostenuto keying is desired; and a unidirectional circuit coupled between said keydown detector and a set lead of said flip-flop circuit so that an initial keydown signal following release of said reset gates places said flip-flop circuit in a set condition whereas the disappearance of said keydown signal is inhibited from resetting said flip-flop circuit.

* * * * *